US009974349B2

(12) United States Patent
Gotti

(10) Patent No.: US 9,974,349 B2
(45) Date of Patent: May 22, 2018

(54) ANTI-RELEASE PROTECTIVE HELMET, IN PARTICULAR FOR SPORTING USE

(71) Applicant: KASK S.p.A., Chiuduno (bg) (IT)

(72) Inventor: Angelo Gotti, Nembro (IT)

(73) Assignee: KASK S.P.A., Chiuduno (IT)

( * ) Notice: Subject to any disclaimer, the term of this patent is extended or adjusted under 35 U.S.C. 154(b) by 222 days.

(21) Appl. No.: 14/895,827

(22) PCT Filed: Jun. 18, 2014

(86) PCT No.: PCT/IB2014/062367

§ 371 (c)(1),
(2) Date: Dec. 3, 2015

(87) PCT Pub. No.: WO2014/203180

PCT Pub. Date: Dec. 24, 2014

(65) Prior Publication Data

US 2016/0128414 A1 May 12, 2016

(30) Foreign Application Priority Data

Jun. 18, 2013 (IT) ..... MI2013A1005

(51) Int. Cl.
*A42B 3/08* (2006.01)

(52) U.S. Cl.
CPC ..... *A42B 3/085* (2013.01)

(58) Field of Classification Search
CPC ..... A42B 3/142; A42B 3/06; A42B 3/085
See application file for complete search history.

(56) References Cited

U.S. PATENT DOCUMENTS 1,522,952 A * 1/1925 Goldsmith ..... A42B 3/00 2/414
2,814,043 A * 11/1957 Alesi ..... A42B 3/085 2/421

(Continued)

FOREIGN PATENT DOCUMENTS

CA 1329863 C 5/1994
EP 0365433 A1 4/1990

OTHER PUBLICATIONS

International Search Report based on International Application No. PCT/IB2014/06237 dated Feb. 9, 2015 (3 pages).

*Primary Examiner* — Richale Quinn
(74) *Attorney, Agent, or Firm* — Lucas & Mercanti, LLP

(57) ABSTRACT

Protective helmet, in particular for sports use, is disclosed; The helmet includes a shell structure shaped so as to at least partially cover the head of a user; and a nape-rest element fixedly connected to the shell structure at the nuchal area of the user; The nape-rest element is constrained to the shell structure in a movable manner between a fitting position, in which it is in substantial contact with the inner rear wall of the shell structure to allow the occipital protuberance of the cranium to be passed over, and a use position in which it is separated from the inner rear wall of the shell structure and in substantial contact with the nuchal area of the user wearing the helmet, the helmet also includes a spring element to force the nape-rest element in the use position in which it is separated from the inner rear wall of the shell structure and in substantial contact with the nuchal area of the user wearing the helmet.

6 Claims, 8 Drawing Sheets

(56) References Cited

U.S. PATENT DOCUMENTS 3,103,014 A * 9/1963 Morgan ..... A42B 3/10 2/415
3,314,077 A * 4/1967 Marchello ..... A42B 3/085 2/421
3,591,863 A * 7/1971 Rickard ..... A42B 3/0473 2/415
3,852,821 A * 12/1974 Mickel ..... A42B 3/127 2/415
4,477,929 A * 10/1984 Mattsson ..... A42B 3/324 2/417
5,042,093 A * 8/1991 Legendre ..... A42B 3/145 2/419
5,572,749 A * 11/1996 Ogden ..... A42B 3/14 2/410
5,638,551 A * 6/1997 Lallemand ..... A42B 3/085 2/421
5,659,900 A * 8/1997 Arney ..... A42B 3/085 2/181
5,774,901 A * 7/1998 Minami ..... A42B 3/085 2/421
5,794,272 A * 8/1998 Workman ..... A42B 3/085 2/421
6,226,802 B1 * 5/2001 Sasaki ..... A42B 3/085 2/417
6,401,261 B1 * 6/2002 Arney ..... A42B 3/085 2/421
7,069,601 B1 * 7/2006 Jacobsen ..... A42B 3/062 2/411
9,403,080 B2 * 8/2016 Jean ..... A42B 3/085
9,480,293 B2 * 11/2016 Pfanner ..... A42B 3/085
2004/0255370 A1 * 12/2004 Moeller ..... A42B 3/085 2/416
2012/0054947 A1 * 3/2012 Durocher ..... A42B 3/085 2/414
2012/0297520 A1 * 11/2012 Gleason ..... A42B 3/142 2/181
2013/0205478 A1 * 8/2013 Pfanner ..... A42B 3/085 2/421
2017/0055623 A1 * 3/2017 Pritz ..... A42B 3/142

* cited by examiner

ANTI-RELEASE PROTECTIVE HELMET, IN PARTICULAR FOR SPORTING USE

CROSS-REFERENCE TO RELATED APPLICATIONS

This application is a 371 of PCT/IB2014/062367, filed Jun. 18, 2014, which claims the benefit of Italian Patent Application No. MI2013A001005, filed Jun. 18, 2013.

FIELD OF THE INVENTION

BACKGROUND OF THE INVENTION

The present invention refers to an anti-release protective helmet, in particular for sporting use.

The object of the present invention is intended to be used in the field of sports in which athletes and/or people practising a particular activity and/or sport, like for example cycling, skating, skiing, motorcycling, horse riding and/or others, wear helmets and/or similar protective headgear for protecting themselves in the case of possible falling and/or accidents.

The object of the present invention is particularly used also in fields other than sports, like for example at work in which it is worth mentioning construction or any other field in which, for safety reasons, it is compulsory or recommended to be provided with proper helmets or similar protective headgear.

As known, there are many different types of sports helmets the shapes and structural characteristics of which vary according to the sport they are intended for.

Despite the numerous differences between the various known helmets for sports use, sport helmets currently present on the market are provided with a protective or shell structure having a substantially arched or wrap-around shape, which is intended to circumscribe most of the head of the user.

The protective structure of such helmets has a concave housing space, which is generally padded, so as to receive the head of the user in engagement, and an external surface, which is usually covered with one or more layers of resistant materials, that is intended to hit and bump possible bodies or objects during falls and/or accidents of the users.

The aforementioned helmets are moreover provided with suitable fixing means, like for example a chinstrap and/or similar adjustable straps, which are associated with the protective structure so as to be blocked at the head of the users according to a predetermined position.

Such helmets can also be provided with one or more accessory elements that can be engaged with the protective structure so as to carry out predetermined functions that can, on one hand, make it more practical and comfortable and, on the other hand, help protect the user from potential dangerous situations.

As it can be understood from the following description, the helmet of the present invention is called anti-release because, in addition to the usual capability of protecting the user from bangs or impact, it also intends to offer comfort, fitting simplicity and stability during use of the helmet.

Of course, in order to reach such purposes the helmet must adhere in an optimal manner to the head of the user.

In the past the most common solution consisted in making helmets having different sizes available on the market.

However, such a solution offers a solution that is not optimal in view of the shape of the head of the user or, more in detail, with reference to the profile of the occipital, or nuchal area, of the human cranium.

Indeed, such an occipital or nuchal portion has a particular protuberance that the helmet, in order for it to be worn correctly, must first "pass over" so as to be correctly arranged in the position of use.

In known helmets without adjustment mechanisms it is clear that if a helmet has a size such as to pass over such a protuberance, once this protuberance has been passed over, the helmet cannot adhere to the nuchal area correctly.

On the contrary, the optimal adherence of the nuchal area would make the helmet difficult to fit past this occipital protuberance.

In order to solve such a drawback, or rather in order to provide easy fitting and optimal adherence to the nuchal area, helmets are known today, which are provided with a manual adjustment that provides for the nuchal portion of the helmet to be loosened or tightened by acting on a command.

In such a way, by keeping the helmet loosened it is possible to wear it easily and, once it is worn, it is possible to tighten it on the nape of the user until it adheres correctly.

The drawback of such a solution, in addition to the complexity of the helmet that often causes such a mechanism to break, is the fact that the user is forced to, in any case, act manually on the helmet making it slower to fit it.

Examples of such a type of helmet are described in U.S. Pat. Nos. 6,226,802, 6,401,261 and in US2004255370 in which these helmets comprise a nape-rest element that is movable between a fitting position, in which it is in substantial contact with the inner rear wall of the helmet to allow the occipital protuberance of the cranium to be passed over, and a use position in which it is separated from said inner rear wall of the helmet and is in substantial contact with the nuchal area of the user.

Means for forcing such a nape-rest element in the position of use so as to increase the safety of the user are furthermore provided.

For example U.S. Pat. No. 6,226,802 comprises a spring element for forcing the nape-rest element into said use position.

However, in U.S. Pat. No. 6,226,802, like also in U.S. Pat. No. 6,401,261 and in US2004255370 the passing from the fitting position to the use position does not occur spontaneously but by means of tools that are suitable for locking the nape-rest element in the fitting position.

In other words also in the helmets described in U.S. Pat. Nos. 6,226,802, 6,401,261 and in US2004255370 after fitting the user is forced to act manually on the helmet so as to free the nape-rest element or for adjusting the contact with the head of the user.

SUMMARY OF THE INVENTION

The main purpose of the present invention is that of making a protective helmet that differs from known ones and, at the same time, is stable, adheres to the nape in an optimal manner and is easy to be wore without requiring any manual adjustment.

According to the general aspect of the invention, the helmet claimed comprises a nape-rest element of the user that is arranged at the nuchal area of the helmet that is configured so as to be brought in a spontaneous and springy manner from the fitting position to the use position without requiring any manual operation by the user.

Such an element is fixedly connected in a movable manner between a fitting position of the helmet, in which it is in substantial contact with the inner rear wall of the shell of the helmet itself so as to allow the occipital protuberance to be passed over, and a position of use in which it is separated from the inner rear wall of the shell structure and is in substantial contact with the nuchal area of the user.

In order to make such an adherence automatic without manual adjustments, a spring element is present that is configured so as to force the aforementioned nape-rest element in the position of use.

In such a way, during the fitting of the helmet, the spring allows the element to retract so as to then pass over the occipital protuberance and then automatically provides for bringing it to a position in which it adheres to the nuchal area of the user making the helmet difficult to be pulled off in case of bangs.

According to another aspect of the invention, the Applicant has identified a shape of the spring that is particularly functional for the purposes stated above.

The purposes specified above, and yet others, are substantially achieved with a protective helmet, in particular for sports use, as expressed and described in the following claims.

BRIEF DESCRIPTION OF THE DRAWINGS

It is now reported, as an example, the description of a preferred, but not exclusive, embodiment of an anti-release protective helmet, in particular for sports use, in accordance with the present invention. Such a description shall be carried out in the rest of the description with reference to the attached drawings, that have been given purely as an indication and therefore not for limiting purposes, in which.

DETAILED DESCRIPTION OF THE INVENTION

Figure 1:
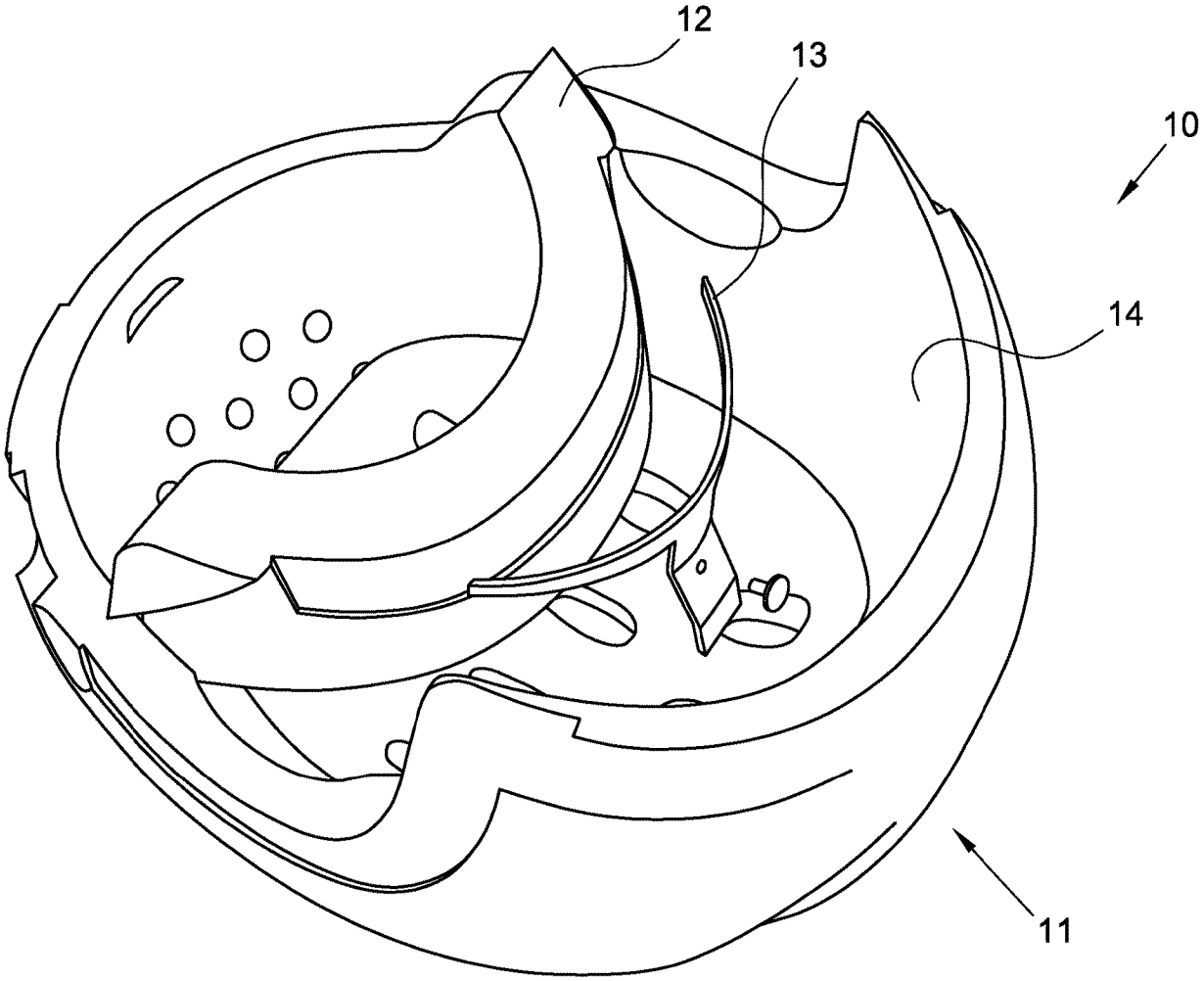
FIG. 1 shows an exploded embodiment of an anti-release protective helmet according to the present invention.

With reference to the attached figures, reference numeral 10 wholly indicates an anti-release protective helmet according to the present invention.

The anti-release protective helmet 10 according to the present invention comprises:

- a shell structure 11 that is shaped so as to at least partially cover the head of a user and is configured so as to protect it from bangs at the cranium portion substantially starting from the eye arch up to the nuchal area both on top and laterally; and
- a nape-rest element 12 that is fixedly connected to the shell structure at the nuchal area of the user.

Since the shell structure 11 is of the known type and does not directly concern peculiar aspects of the invention, both the materials and the accessory elements that form it shall not be listed for the sake of clarity of the description.

The nape-rest element 12, as shall become clearer from the rest of the description, has the main function of making the worn helmet stable and of preventing it from accidentally pulling off by adhering to the nape of the user.

The shell 11 and the nape-rest element 12 are visible in FIG. 1 which shows an exploded view of an embodiment of an anti-release protective helmet 10 according to the present invention.

Figure 3:
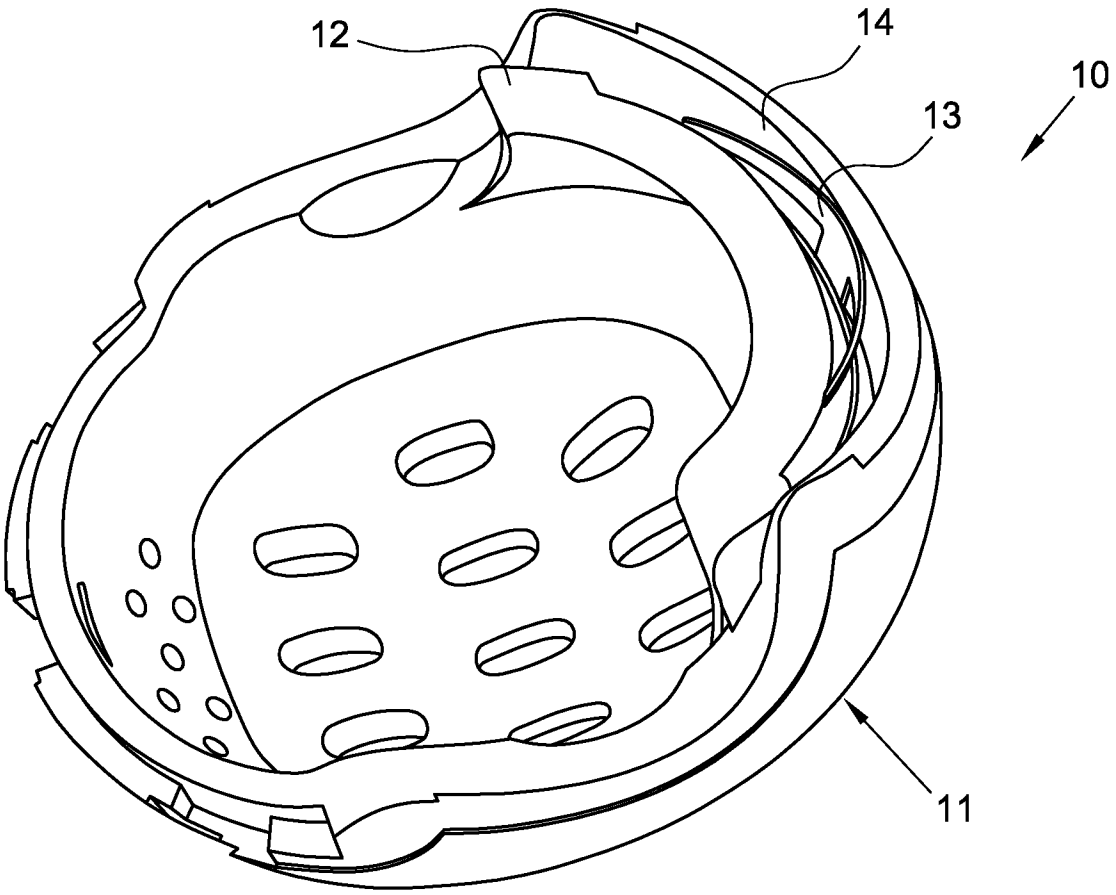
FIGS. 3-5 show the helmet of FIG. 1 in different configurations that can be obtained without any manual adjustment.
Figure 4:
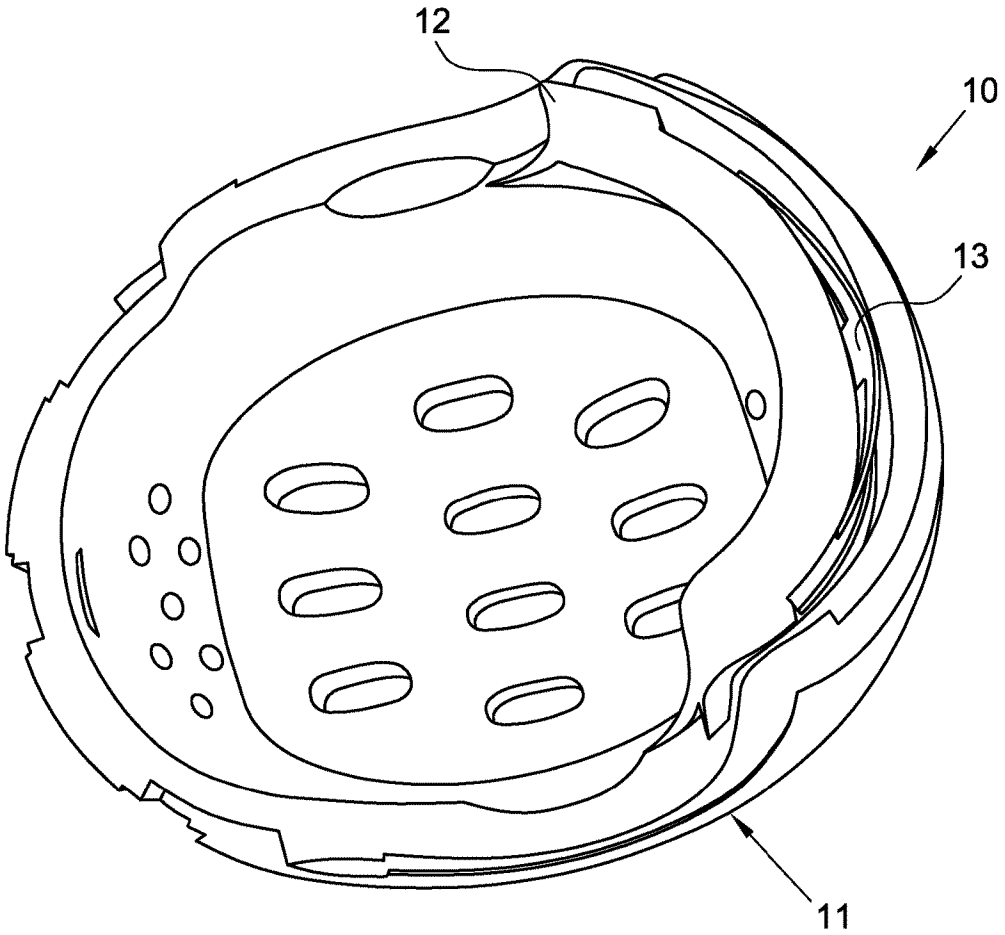
Figure 5:
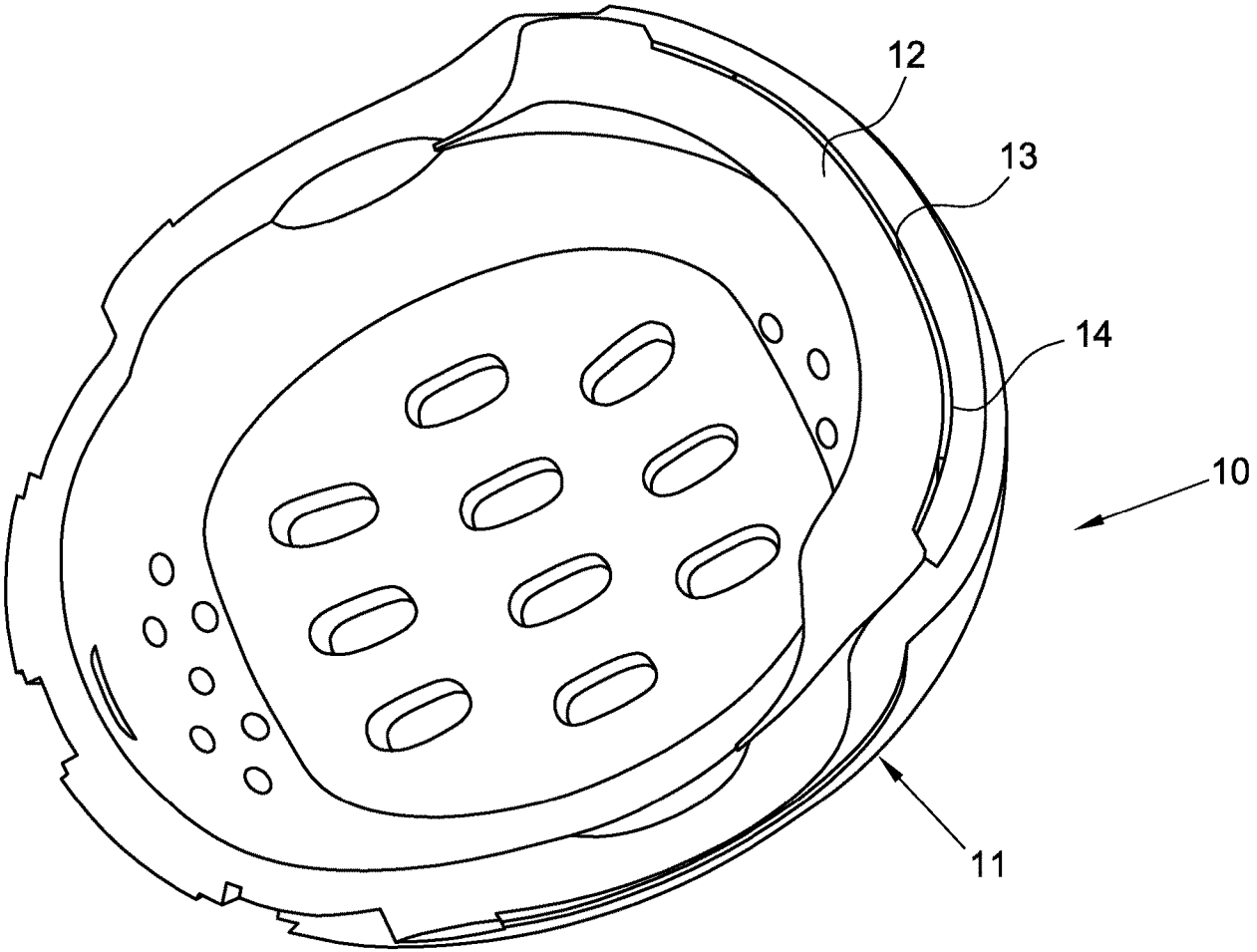

According to the present invention, and as visible in FIGS. 3-5, the nape-rest element 12 is constrained to the shell structure 11 in a movable manner between a fitting position of the helmet 10, in which it is in substantial contact with the inner rear wall 14 of the shell structure 11, and a use position of the helmet 10 in which it is separated from the inner rear wall 14 of the shell structure 11 and in substantial contact with the nuchal area of the user wearing the helmet 10.

Even more in particular, the helmet 10 comprises a spring element 13 that is configured so as to force the nape-rest element 12 into its use position in which it is separated from the inner rear wall 14 of the shell structure 11 and in substantial contact with the nuchal area of the user wearing the helmet 10.

In such a way, during the fitting of the helmet, the spring 13 allows the nape-rest element 12 to retract so as to pass over the occipital protuberance and then it automatically brings it into a position in which it adheres to the nape of the user without any manual adjustment.

As shown, the nape-rest element 12 is substantially a C-shaped element with an inner profile that is configured so as to adhere, during use, to the nape of the user and with an outer profile that is configured so as to adhere, when fitted, to the inner rear wall 14 of the shell structure 11.

Figure 2:
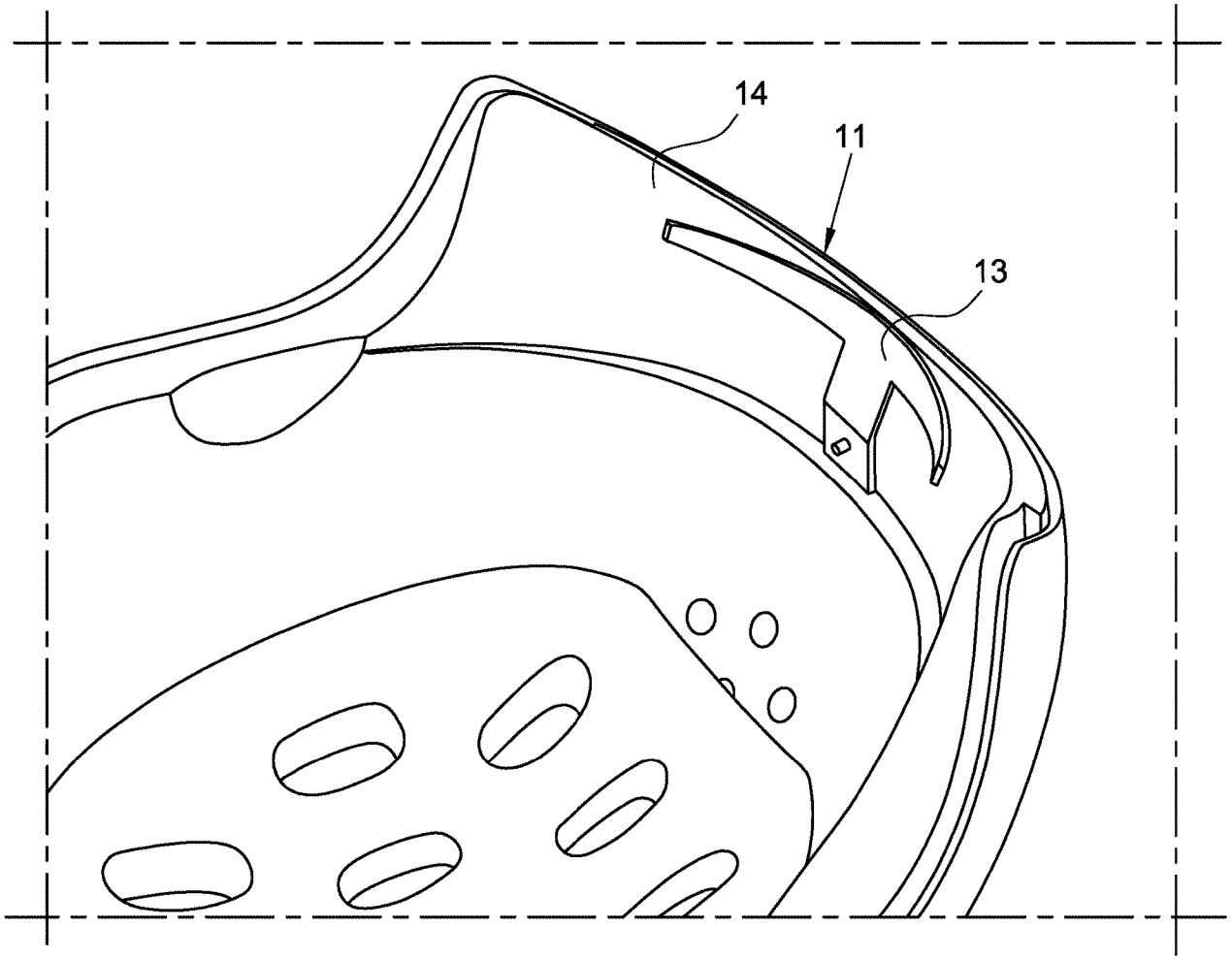
FIG. 2 shows a detail of the helmet of FIG. 1.

The spring 13, as visible in FIG. 2, is a leaf spring that is arranged between the nape-rest element 12 and the inner rear wall 14 of the shell structure 11.

More in detail, in the constructive example shown, the spring 13 comprises a C-shaped leaf 15 in which the central portion 16 is in substantial contact with the inner rear wall 14 of the shell structure 11 and the lateral portions 17 are separated from the inner rear wall 14 and are directed towards the inside of the shell structure 11.

In such a way, when they are compressed, the lateral portions 17 act on the nape-rest element 12 so as to push it inwards with respect to the helmet 11 and therefore adhering to the nape of the user.

Figure 6:
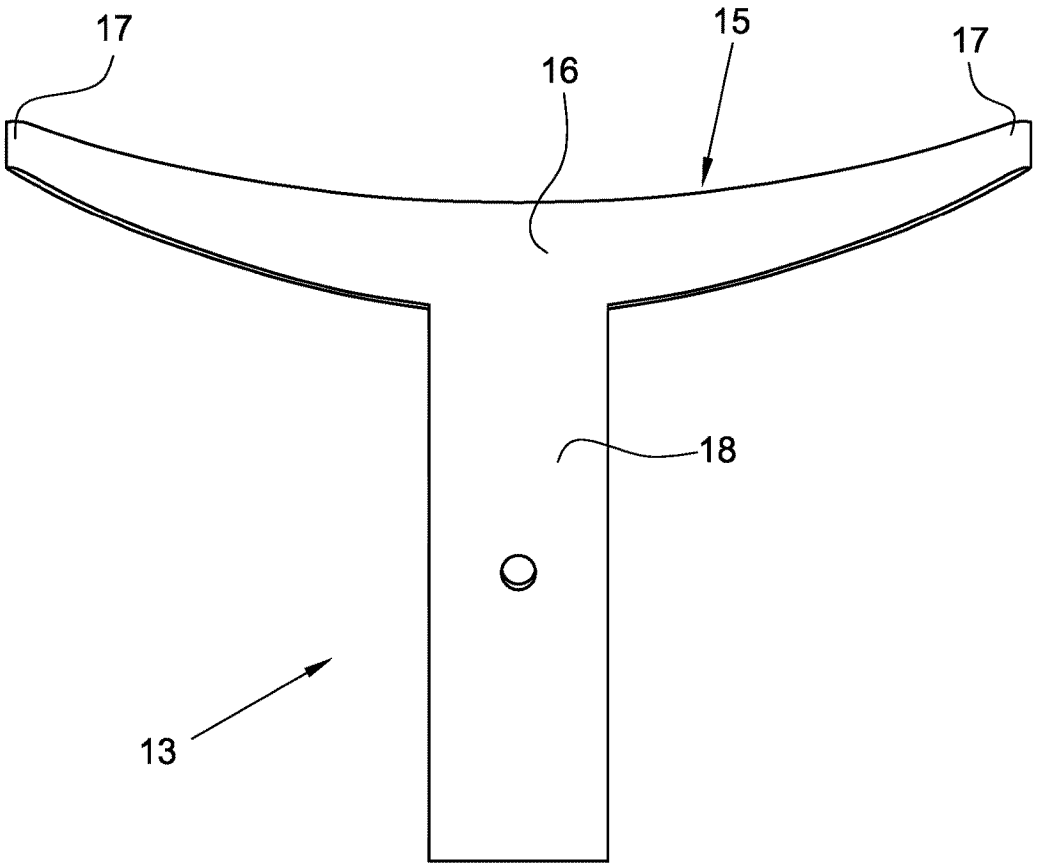
FIGS. 6-8 show an embodiment of a spring element that makes it possible to achieve the configurations that are shown in FIGS. 3-5 without any manual adjustment.
Figure 7:
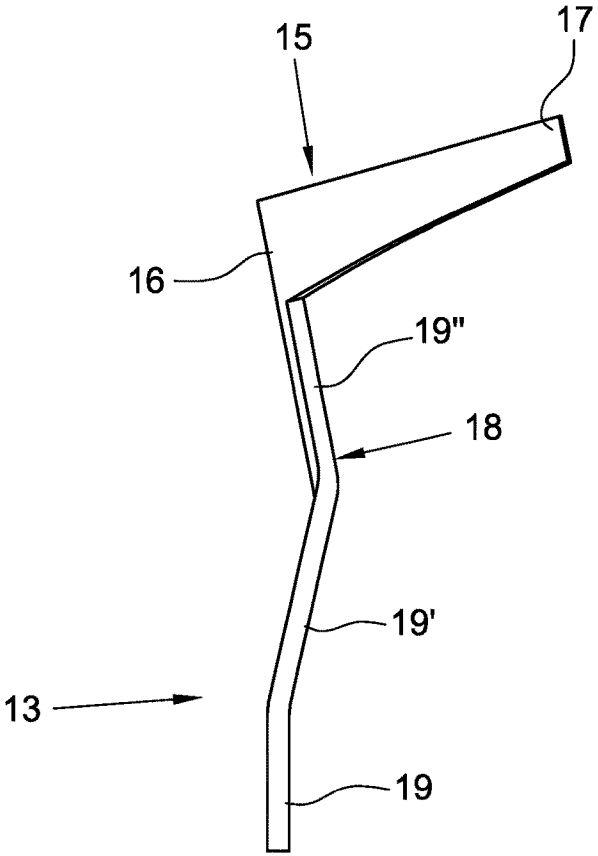
Figure 8:
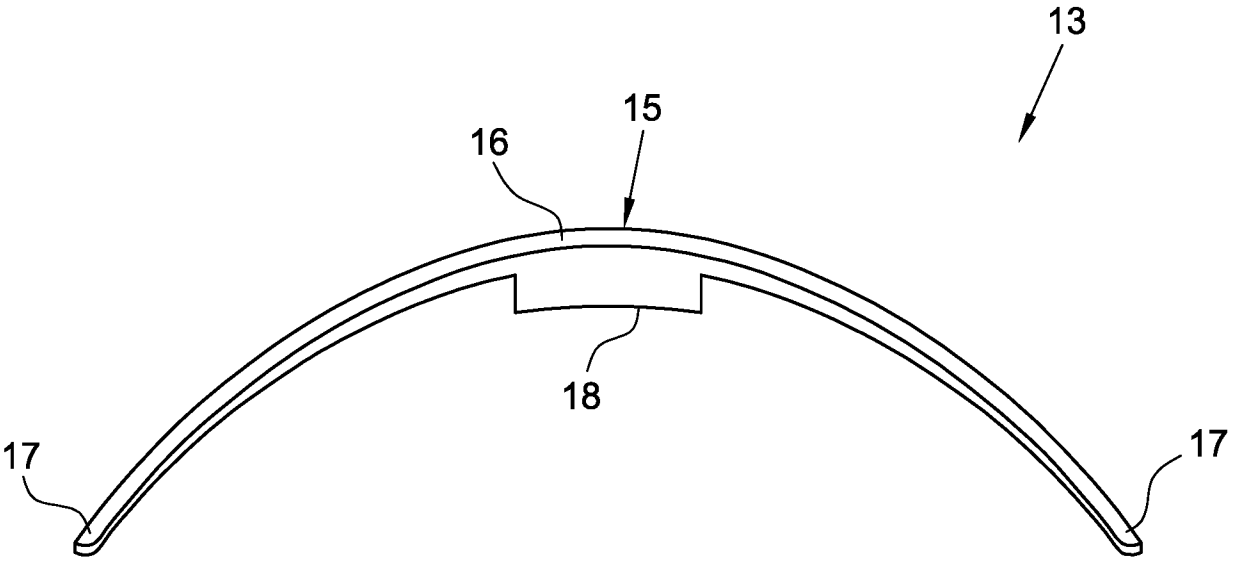

As visible in FIGS. 6-8, the spring 13 comprises a stem portion 18 that extends from the central portion in a direction that is orthogonal with respect to the C-shaped leaf 15.

The stem portion 18 comprises a plurality of sections 19, 19', 19" with a variable inclination and is constrained to the shell structure 11, for example by means of a pocket for receiving said stem.

The spring 13 is then fixedly connected to the nape-rest element 12, for example by means of a screw.

Finally, the nape-rest element 12 comprises, at the back, a lowered seat for receiving the C-shaped leaf 15.

It has thus been seen that an anti-release protective helmet according to the present invention achieves the aforementioned highlighted purposes.

Very briefly, the following advantages can be listed:

- greater safety for the user due to the greater adherence to the nuchal area and to the greater ability of the helmet to remain secure and stable on the head thanks to the automatic and fast closing system;
- perfect adaptability to the shape of the nuchal area;
- increased comfort;
- ease of use.

The anti-release protective helmet of the present invention thus conceived can undergo numerous modifications and variants, all covered by the same inventive concept; moreover, all the details can be replaced by technically equivalent elements. In practice, the materials used, as well as their sizes, can be of any type according to the technical requirements.

The invention claimed is:

1. Protective helmet comprising:

a shell structure shaped so as to at least partially cover a user's head and configured to protect it from bangs at the cranium portion substantially starting from the eye arch up to the nuchal area both on top and laterally; and a nape-rest element fixedly connected to said shell structure at the nuchal area of the user; said nape-rest element is constrained to said shell structure in a movable manner between a fitting position of said helmet, in which it is in substantial contact with the inner rear wall of said shell structure to allow the occipital protuberance of the cranium to be passed over, and a use position of said helmet in which it is separated from said inner rear wall of said shell structure and in substantial contact with the nuchal area configured for the user wearing said helmet, said helmet comprises a spring element to force said nape-rest element in said use position in which it is separated from said inner rear wall of said shell structure and in substantial contact with the nuchal area configured for wearing said helmet, wherein said spring comprises a C-shaped leaf in which a central portion is in substantial contact with said inner rear wall of said shell structure and lateral portions extending from said central portion are separated from said inner rear wall of said shell structure and directed towards the inside of said shell structure;

wherein said nape-rest element is configured so as to pass spontaneously and in a springy manner from the fitting position to the use position without requiring any manual operation to the user;

wherein said nape-rest element comprises, at the back, a seat for receiving said C-shaped leaf; and wherein said nape-rest element is substantially C-shaped with inner profile configured so as to adhere during use to the user wearing said helmet and with outer profile configured so as to adhere during fitting to said inner rear wall of said shell structure, said C-shaped leaf being arranged between said nape-rest element and said inner rear wall of said shell structure.

2. Helmet according to claim 1, wherein said spring comprises a stem portion that extends from said central portion in an orthogonal direction to said C-shaped leaf; said stem portion being constrained to said shell structure.

3. Helmet according to claim 1, wherein said stem portion comprises a plurality of sections having different inclinations.

4. Helmet according to claim 2, wherein said stem portion has a substantially uniform width.

5. Helmet according to claim 1, wherein said lateral portions are arcuate relative to said central portion.

6. Helmet according to 2, wherein said stem portion and said lateral portions are substantially equal in length.

* * * * *